US008894188B2

(12) United States Patent
Ozawa

(10) Patent No.: US 8,894,188 B2
(45) Date of Patent: Nov. 25, 2014

(54) LIQUID EJECTION HEAD AND LIQUID EJECTION APPARATUS

(71) Applicant: Seiko Epson Corporation, Tokyo (JP)

(72) Inventor: Kinya Ozawa, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/953,068

(22) Filed: Jul. 29, 2013

(65) Prior Publication Data

US 2014/0028759 A1 Jan. 30, 2014

(30) Foreign Application Priority Data

Jul. 30, 2012 (JP) ..... 2012-168077

(51) Int. Cl.
*B41J 2/045* (2006.01)
*B41J 2/14* (2006.01)

(52) U.S. Cl.
CPC ..... *B41J 2/14* (2013.01); *B41J 2202/11* (2013.01); *B41J 2/14233* (2013.01)
USPC ..... 347/68

(58) Field of Classification Search
CPC ..... B41J 2/161; B41J 2/04581; B41J 2/14201
USPC ..... 347/68, 70–72
See application file for complete search history.

(56) References Cited

U.S. PATENT DOCUMENTS 6,382,781 B2 * 5/2002 Furuhata et al. ..... 347/68
2012/0249666 A1 10/2012 Maki et al.

FOREIGN PATENT DOCUMENTS

| | | | |
|---|---|---|---|
| JP | 2001-232792 | A | 8/2001 |
| JP | 2012-001581 | A | 1/2012 |
| JP | 2012-207119 | A | 10/2012 |
| JP | 2012-219202 | A | 11/2012 |
| JP | 2012-245713 | A | 12/2012 |
| JP | 2012-250401 | A | 12/2012 |
| JP | 2013-006333 | A | 1/2013 |

* cited by examiner

*Primary Examiner* — An Do
(74) *Attorney, Agent, or Firm* — Harness, Dickey & Pierce, P.L.C.

(57) ABSTRACT

A recording head that is configured to eject ink containing tabular particles from nozzles includes pressure chambers, a pressure generating unit that generates pressure change in the pressure chambers, a reservoir that communicates with the pressure chambers, and an ink supply path that connects the pressure chambers and the reservoir, wherein a plurality of protrusions are formed on an inclined surface which is continuous with a wall of the pressure chambers and a wall of the ink supply paths at the boundary between the pressure chambers and the ink supply paths where a flow path cross-sectional area changes, and the plurality of protrusions project into the flow path from the wall surface.

6 Claims, 8 Drawing Sheets

LIQUID EJECTION HEAD AND LIQUID EJECTION APPARATUS

BACKGROUND

1. Technical Field

The present invention relates to a liquid ejection head such as an ink jet recording head and a liquid ejection apparatus having the same, and more specifically to a liquid ejection head that ejects liquid containing tabular particles such as metal pigment and a liquid ejection apparatus having the same.

2. Related Art

A liquid ejection apparatus has a liquid ejection head that is capable of ejecting liquid as liquid droplets from nozzles and is configured to eject a variety of liquid from the liquid ejection head. Typical example of liquid ejection apparatus includes an image recording apparatus such as an ink jet recording apparatus (printer) that has an ink jet recording head (hereinafter, referred to as "recording head") and is configured to perform recording by ejecting ink in the form of liquid as ink droplets from the nozzles of the recording head. Further, the liquid ejection apparatus is also used to eject a variety of liquid such as a color material used for color filters of liquid crystal displays, an organic material used for organic electro luminescence (EL) displays, and an electrode material used for making electrodes. The recording head for image recording apparatus ejects ink in the form of liquid, and a color material ejection head for display manufacturing apparatuses ejects solution of color materials, red (R), green (G) and blue (B). Further, an electrode material ejection head for electrode manufacturing apparatuses ejects an electrode material in the form of liquid, and a bio-organic material ejection head for chip manufacturing apparatuses ejects a bio-organic solution.

The liquid ejection head using an ink jet technique includes a plurality of nozzles, pressure chambers which are provided for each of the respective nozzles, a common liquid chamber (also referred to as reservoir or manifold) which are provided for a plurality of pressure chambers, and liquid flow paths such as a supply path that connects the common liquid chamber and each of the pressure chambers. The liquid ejection head is configured to eject liquid from the nozzles when a pressure change is applied to liquid in the pressure chambers by driving a pressure generating unit such as a piezoelectric element and a heat generating element.

Recently, as described in JP-A-2012-001581, ink jet technology is applied to ejection of metallic ink containing metal particles as pigment. In order to achieve metallic gloss on the printed material which is printed by using metallic ink, the metal particles should have a surface as flat as possible. Accordingly, the metal pigment contained in the metallic ink is made from tabular (flake like) particles.

FIG. 8 is a schematic view showing an example of configuration of a liquid flow path of the recording head. In FIG. 8, the arrow indicates a flow of ink. As shown in the figure, the respective pressure chambers 51 communicate with a reservoir 53 (common liquid chamber) via ink supply paths 52. The ink supply paths 52 have a cross-sectional area which is sufficiently smaller than that of the pressure chambers 51. As a result, the cross-sectional area of the flow paths significantly changes at the boundary between the ink supply paths 52 and the pressure chambers 51. As ink flows from the reservoir to the pressure chambers 51 via the ink supply paths 52, the cross-sectional area of the flow paths increases, which causes the flow speed of ink flowing from the ink supply paths 52 to the pressure chambers 51 to decrease. In particular, the flow speed in an area (which is denoted by X in FIG. 8) outside the extension area of the ink supply paths 52 into the pressure chambers 51 is lower than in the extension area. This causes a boundary layer separation at the boundary between the area X and the extension area, and thus generates turbulent flow, that is, eddying flow in the pressure chambers 51. The eddying flow causes the local flow of the tabular particles in metallic ink moving in circle (revolve). The revolving flow of the tabular particles in a small area in the pressure chambers causes an adverse effect to ink ejection. Specifically, problems such as turning of flying direction of ink ejected from the nozzles 54 and ejection failure of ink from the nozzles 54 may occur.

Such problems are not limited to occur in the ink jet recording heads that eject metallic ink, but also occur in other liquid ejection heads that eject liquid containing tabular particles.

SUMMARY

An advantage of some aspects of the invention is that the liquid ejection head configured to eject tabular particles while preventing liquid ejection problem due to a local revolving flow of tabular particles in the flow path, and the liquid ejection apparatus having the same are provided.

According to an aspect of the invention, a liquid ejection head that is configured to eject liquid containing tabular particles includes, a plurality of nozzles that eject liquid; a plurality of pressure chambers that communicate with the plurality of nozzles; a pressure generating unit that generates pressure change in the pressure chambers; a common liquid chamber that communicates with the plurality of pressure chambers; and a liquid supply path that connects the plurality of pressure chambers and the common liquid chamber, wherein a resistance section that resists a flow of liquid is formed on a wall surface which is continuous with a wall of the pressure chambers and a wall of the liquid supply paths and is located in an area in which a flow path cross-sectional area changes.

Accordingly, since the resistance section that resists a flow of liquid is provided at the boundary where the cross-sectional area of the flow paths changes between the pressure chambers and the ink supply paths on the wall surface which is continuous with a wall of the pressure chambers and the wall of the ink supply paths, small turbulent flows are generated by the resistance section in vicinity to the wall surface when ink flows from the liquid supply paths to the pressure chambers. That is, a boundary layer of turbulent flow is formed in vicinity to the wall surface. As a consequence, separation does not easily occur between a flow from the ink supply paths to the pressure chambers (laminar flow) and the boundary layer of turbulent flow, thereby preventing occurrence of a larger turbulent flow (eddying flow). Accordingly, when liquid containing tabular particles is ejected, a local revolving flow of tabular particles due to the eddying flow is not occurred at the boundary between the ink supply paths and the pressure chambers, thereby allowing ink containing the tabular particles to smoothly flow toward the nozzles. Therefore, it is possible to prevent occurrence of ejection problems due to revolving of tabular particles in the pressure chambers, that is, turning of flying direction of ink ejected from the nozzles and a so-called missing dots which is a failure of ejection of liquid from the nozzles.

In the above aspect of the invention, the resistance section is desirably formed as protrusions that project into the flow path from the wall surface in the area in which the flow path cross-sectional area changes or as dents that are recessed into the opposite side of the flow path from the wall surface in the area in which the flow path cross-sectional area changes.

With this configuration, it is possible to form the boundary layer of turbulent flow in the liquid flowing in vicinity to the wall surface with a simple configuration of providing protrusions or dents on the wall surface.

According to another aspect of the invention, a liquid ejection apparatus includes the liquid ejection head according to the above aspect of the invention.

Accordingly, by using the above-mentioned liquid ejection head, it is possible to prevent occurrence of ejection problems due to revolving of tabular particles in the pressure chambers, that is, turning of flying direction of ink ejected from the nozzles and a so-called missing dots which is a failure of ejection of liquid from the nozzles.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of the invention will be described below with reference to the attached drawings. Although various limitations are made as preferred examples of the invention in the following embodiment, the invention is not limited thereto unless otherwise specifically described herein. In the following description, a recording head 2 which is a type of a liquid ejection head will be described as a liquid ejection head of the invention.

Figure 1:
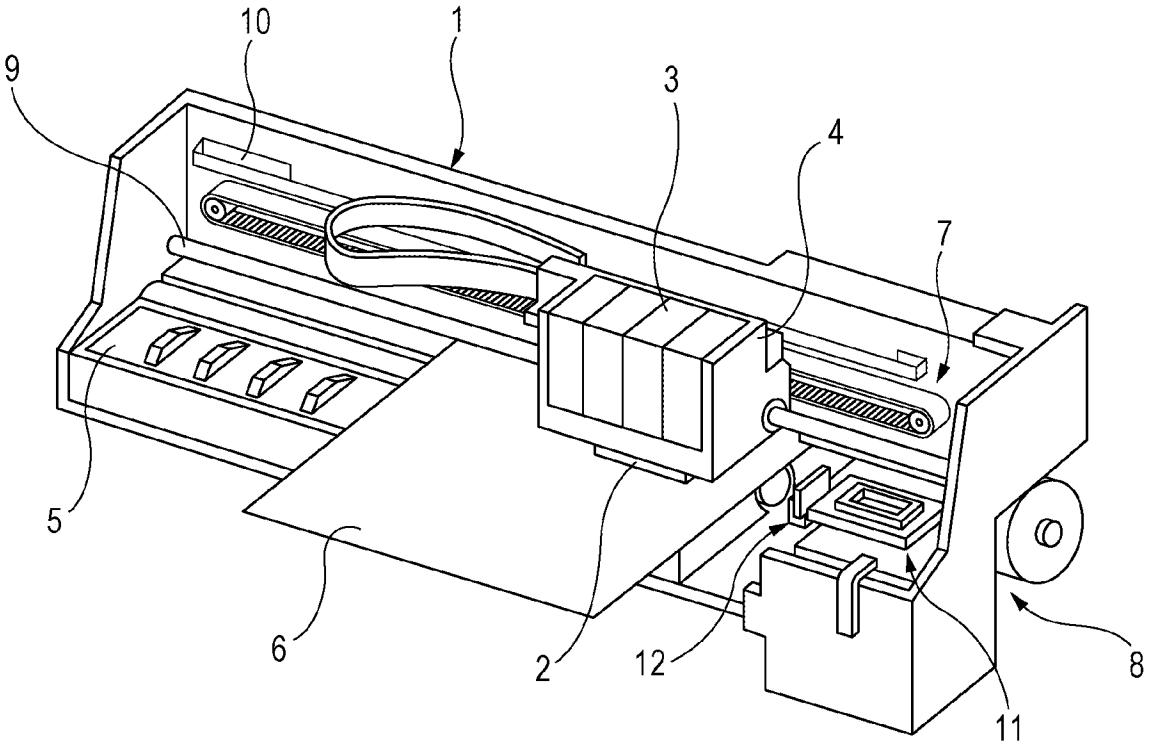
FIG. 1 is a perspective view showing a configuration of a printer.

FIG. 1 is a perspective view showing a configuration of a printer 1. The printer 1 includes a carriage 4 with the recording head 2 being mounted on the carriage 4 and with ink cartridges 3 which is a type of liquid supply source being detachably mounted on the carriage 4, a platen 5 that is disposed under the recording head 2 during a recording operation, a carriage movement mechanism 7 that reciprocates the carriage 4 in a paper width direction of a recording paper 6 (which is a recording medium and a type of ejection target), that is, in a main scan direction, and a sheet feeding mechanism 8 that transports the recording paper 6 in a sub-scan direction which is perpendicular to the main scan direction.

The carriage 4 is supported on a guide rod 9 which extends in the main scan direction. The carriage 4 is configured to move in the main scan direction along the guide rod 9 by operation of a carriage movement mechanism 7. The position of the carriage 4 in the main scan direction is detected by a linear encoder 10, and a detection signal, that is, an encoder pulse is transmitted to a printer controller, which is not shown in the figure. The linear encoder 10 is a type of positional information output unit and is configured to output an encoder pulse corresponding to a scan position of the recording head 2 as positional information in the main scan direction. This allows the printer controller to recognize the scan position of the recording head 2 mounted on the carriage 4 based on the received encoder pulse. That is, for example, the position of the carriage 4 can be recognized by counting the received encoder pulse. Accordingly, the printer controller can control a recording operation of the recording head 2 while recognizing the scan position of the carriage 4 (recording head 2) based on the encoder pulse from the linear encoder 10.

A home position which serves as a base point of scanning by the carriage 4 is provided in an end area which is in a movement range of the carriage 4 and outside of a recording area. In this embodiment, a capping member 11 that seals the nozzle forming surface (nozzle forming substrate 15; see FIG. 2) of the recording head 2 and a wiper member 12 that wipes the nozzle forming surface are disposed at the home position. The printer 1 is configured to perform so-called bidirectional recording in which text and images are recorded on the recording paper 6 while the carriage 4 moves in two directions, that is, from the home position to the opposite end and from the opposite end to the home position.

Figure 2A:
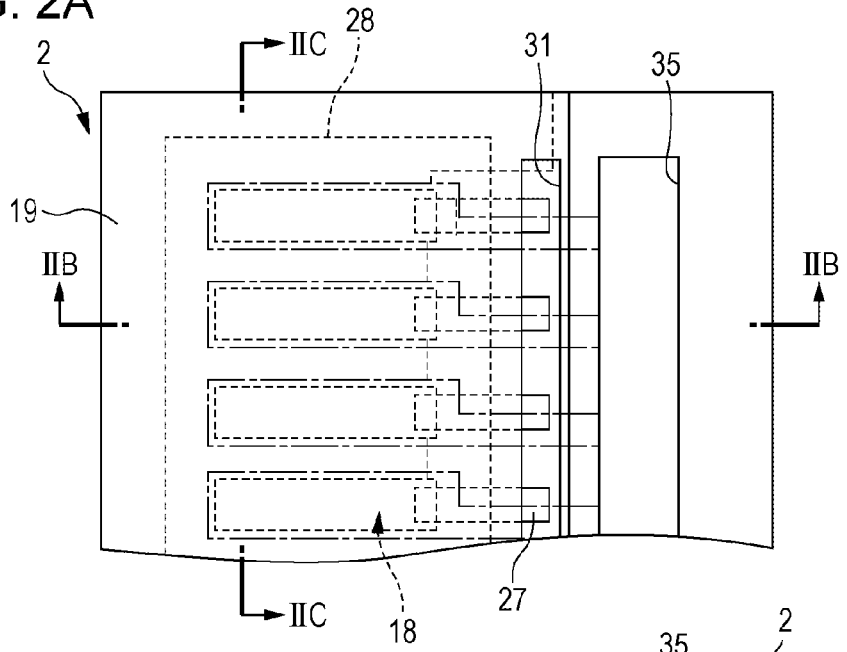
FIGS. 2A, 2B and 2C are perspective views showing a configuration of a recording head.
Figure 2B:
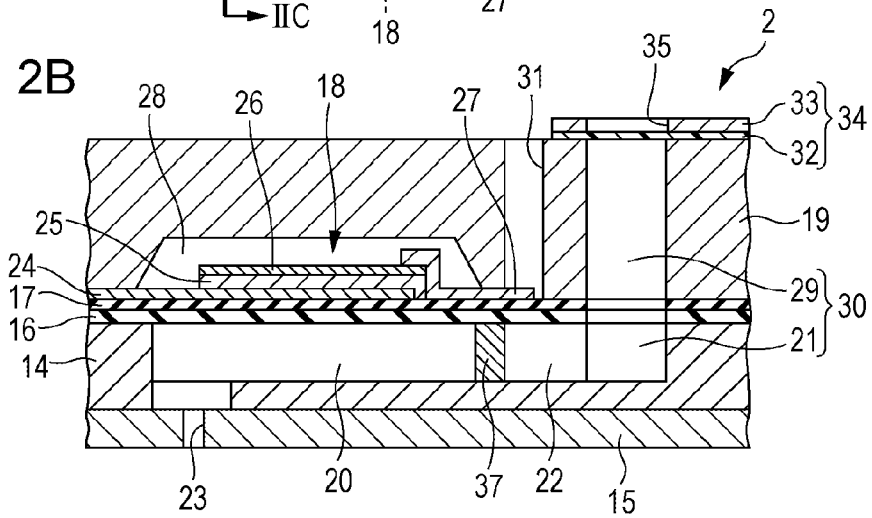
Figure 2C:
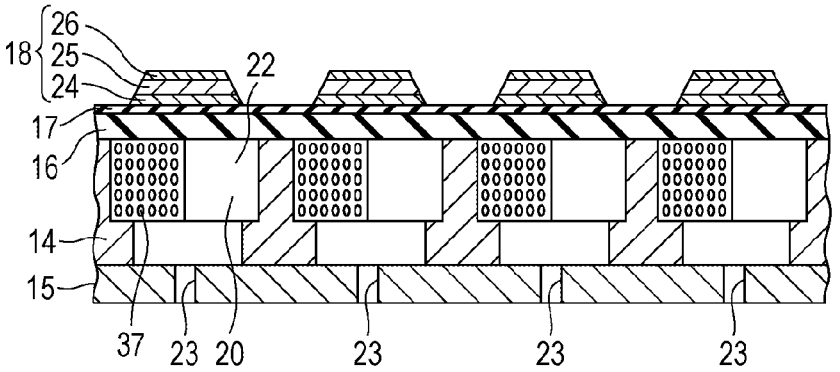

FIGS. 2A, 2B and 2C are configuration views of the recording head 2 of this embodiment. FIG. 2A is a partial plan view of the recording head 2, FIG. 2B is a sectional view taken along the line IIB-IIB of FIG. 2A, and FIG. 2C is a sectional view taken along the line IIC-IIC of FIG. 2A. A protective substrate 19 is not shown in FIG. 2C. Although FIG. 2C shows a configuration of four nozzles, the remaining nozzles have the same configuration. The recording head 2 of this embodiment is formed by stacking a pressure chamber substrate 14, a nozzle forming substrate 15, an elastic film 16, an insulator film 17, piezoelectric elements 18, a protective substrate 19 and the like.

The pressure chamber substrate 14 is a plate member made from, for example, a silicon single crystal substrate. In the pressure chamber substrate 14, a plurality of pressure chambers 20 are arranged in the width direction (nozzle array direction) with partition walls 36 (see FIG. 2C) interposed therebetween. A communication section 21 is formed in the pressure chamber substrate 14 at a position outside of the pressure chambers 20 in the longitudinal direction (a direction perpendicular to the nozzle array direction). The communication section 21 and the respective pressure chambers 20 communicate with each other via an ink supply paths 22 (which correspond to a liquid supply path of the invention) formed for the respective pressure chambers 20. Further, the communication section 21 communicates with a reservoir section 29 of the protective substrate 19, which will be described later, so as to form part of a reservoir 30 that serves as a common ink chamber of the pressure chambers 20. That is, a flow path cross-sectional area (cross-sectional area in the nozzle array direction) of the ink supply paths 22 is smaller than a cross-sectional area of the pressure chambers 20. In this embodiment, a width of the ink supply paths 22 in the nozzle array direction is smaller than a width of the pressure chambers 20 in the nozzle array direction. A plurality of protrusions 37 are arrayed in matrix on each of inclined surfaces 39 (which correspond to a wall surface of the invention) formed at the boundary between the ink supply paths 22 and the pressure chambers 20 where the flow path cross-sectional area changes. The details of this configuration will be described later. The flow paths such as the pressure chambers 20 and the ink supply paths 22, and the protrusions 37 are formed on the pressure chamber substrate 14 by anisotropic etching.

The nozzle forming substrate 15 is attached on the underside of the pressure chamber substrate 14. A plurality of nozzles 23 are formed in array in the nozzle forming substrate 15 so as to correspond to the respective pressure chambers 20. Accordingly, the opening of the pressure chambers 20 on the underside of the pressure chamber substrate 14 are sealed by the nozzle forming substrate 15, which forms the bottom of the pressure chambers 20. An elastic film 16 made of, for example, silicon dioxide ($SiO_2$) is disposed on the top of the pressure chamber substrate 14. Further, an insulator film 17 made of zirconium oxide ($ZrO_2$) is disposed on the elastic film 16. Portions of the elastic film 16 and the insulator film 17 which seal the openings of the pressure chambers 20 serve as working surfaces. Further, lower electrodes 24, piezoelectric bodies 25 and upper electrodes 26 are stacked on the insulator film 17 and form the piezoelectric elements 18.

Generally, one of the electrodes of the piezoelectric elements 18 is provided as a common electrode, and the other of the electrodes (positive electrodes or individual electrodes) and the piezoelectric bodies 25 are patterned for the respective pressure chambers 20. A portion which is formed by one of the patterned electrodes and piezoelectric bodies 25 and where a piezoelectric deformation occurs in response to voltage applied to the electrodes is referred to as a piezoelectric body active portion. Although the lower electrodes 24 are provided as a common electrode of the piezoelectric elements 18 and the upper electrodes 26 are provided as individual electrodes of the piezoelectric elements 18 in this embodiment, the entire configuration can be reversed for convenience of polarization direction of the piezoelectric bodies 25, a drive circuit and wirings. In either case, the piezoelectric body active portions are formed for the respective pressure chambers 20. Further, lead electrodes 27 which are made of, for example, gold (Au) are each connected to the upper electrodes 26 of the piezoelectric elements 18.

The protective substrate 19 is attached on a surface of the pressure chamber substrate 14 which faces the piezoelectric elements 18. The protective substrate 19 has piezoelectric element holding sections 28 at positions which correspond to the respective piezoelectric elements 18. The piezoelectric element holding sections 28 are sized so as not to interfere with displacement of the piezoelectric elements 18. The protective substrate 19 also has a reservoir section 29 at a position which corresponds to the communication section 21 of the pressure chamber substrate 14. The reservoir section 29 is a through hole formed in the protective substrate 19 and has a rectangular opening which is elongated in a direction in which pressure chambers 20 are arranged in parallel. As described above, the reservoir section 29 communicates with the communication section 21 of the pressure chamber substrate 14 so as to form the reservoir 30 (a type of common liquid chamber). The reservoir 30 is provided for each of the types (colors) of ink, and stores ink for all of a plurality of pressure chambers 20.

Further, the protective substrate 19 has a through hole 31 that penetrates the protective substrate 19 in the thickness direction at a position between the piezoelectric element holding sections 28 and the reservoir section 29 such that a portion of the lower electrode 24 and an end of the lead electrode 27 are exposed in the through hole 31. A compliance substrate 34 that is composed of a sealing film 32 and a fixation plate 33 is attached on the top of the protective substrate 19. The sealing film 32 is made of a flexible material (for example, polyphenylene sulfide film) and seals one side of the reservoir section 29. The fixation plate 33 is made of a hard material such as metal (for example, stainless steel). An opening 35 is formed to penetrate the fixation plate 33 in the thickness direction at a position which faces the reservoir 30. Accordingly, one side of the reservoir 30 is sealed solely by the flexible sealing film 32.

In the recording head 2 having the above-mentioned configuration, ink is supplied from an ink supply unit such as an ink cartridge so that a flow path from the reservoir 30 to the nozzles 23 is filled with ink. Then, an electric field which corresponds to a potential difference between the lower electrodes 24 and the upper electrodes 26 is applied between the lower electrodes 24 and the upper electrodes 26 which correspond to the pressure chambers 20 in response to a driving signal from the printer body. This causes the piezoelectric elements 18 and the working surface (elastic film 16) to be flexibly deformed, thereby generating pressure change in the pressure chambers 20. By controlling the pressure change, ink can be ejected from the nozzles 23, or alternatively, micro-vibration of the meniscus at the nozzles 23 can be occurred to the extent that ink is not ejected.

In the recording head 2 of this embodiment, ink (a type of liquid of the invention) containing photoluminescent pigment is used. An example of photoluminescent pigment includes, for example, metal pigment such as aluminum and pearl pigment made from mica particles coated with metal oxide. Particles constituting such a photoluminescent pigment generally have a flat tabular (flake-like) shape. That is, photoluminescent pigment corresponds to tabular particles in the invention. The "tabular particle" refers to a particle having a substantially flat surface (X-Y plane) and a thickness Z which is sufficiently small relative to a dimension in each of X and Y (for example, ½ or smaller), or relative to an equivalent circle diameter of the X-Y plane. The "equivalent circle diameter" refers to a diameter of the circle having an area equal to the projected area of a substantially flat surface (X-Y plane) of the tabular particle of the photoluminescent pigment. The "substantially flat surface" refers to a surface having the maximum projected area of the tabular particle. The photoluminescent pigment of this embodiment is made by breaking a metal vapor deposition film.

The printer 1 of the invention is characterized in that problems in ejecting ink containing the tabular particles from the recording head 2 are reduced by improving the shape of ink flow path, especially the ink flow path at the boundary between the ink supply paths 22 and the pressure chambers 20.

Figure 3:
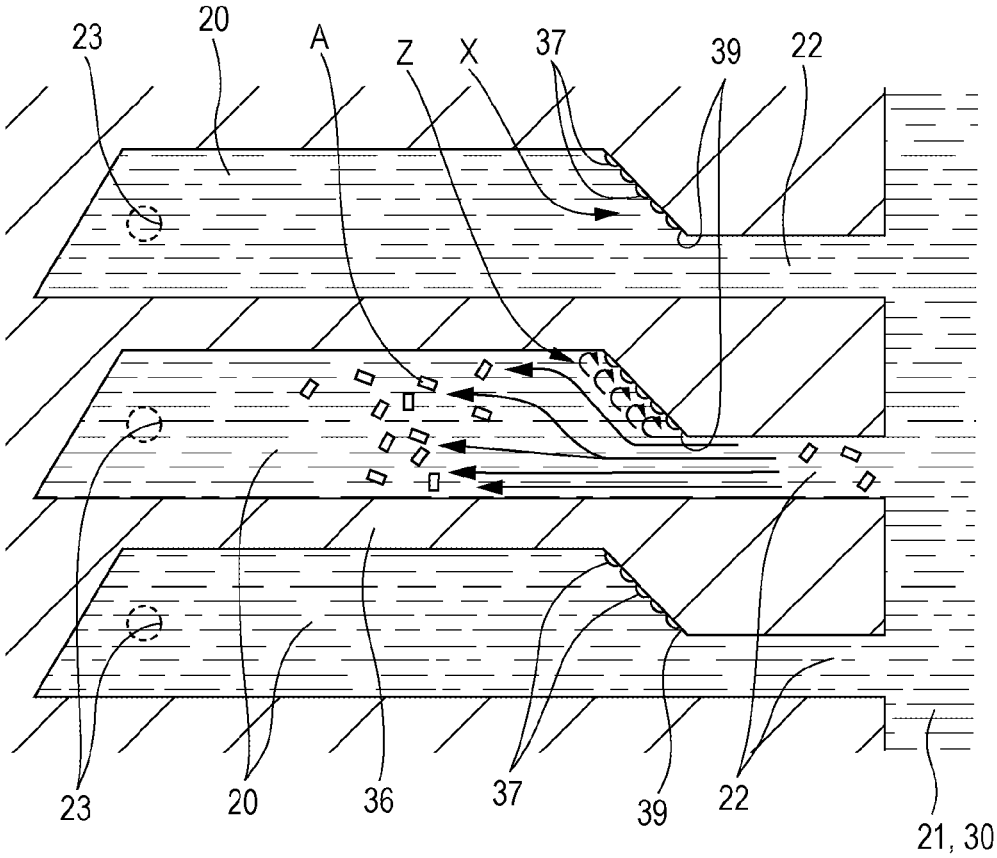
FIG. 3 is a plan view of an essential part showing a configuration of a pressure chamber forming substrate.
Figure 4:
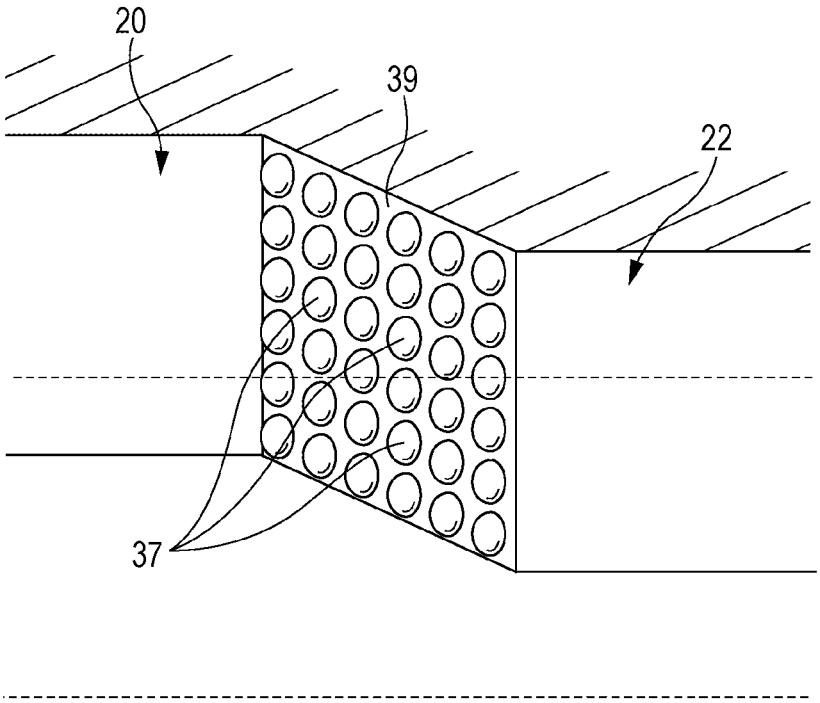
FIG. 4 is a perspective view of a wall at the boundary between an ink supply path and a pressure chamber.

FIG. 3 is a plan view of an essential part of the pressure chamber substrate 14. FIG. 4 is a perspective view of the inclined surface 39 at the boundary between the ink supply paths 22 and the pressure chambers 20. The arrow in FIG. 3 indicates the flow of ink. Although FIG. 3 shows a configuration for three nozzles, the ink flow paths which correspond to other nozzles 23 have the same configuration. As described above, the protrusions 37 (a type of resistance section of the invention) that resist the flow of ink are formed at each of the boundary between the ink supply paths 22 and the pressure chambers 20. More specifically, a plurality of protrusions 37 projecting into the flow path are formed on the inclined surface 39 that connects the wall of the ink supply paths 22 and the wall of the pressure chambers 20 in an area (which is denoted by X in FIG. 3) in which the flow path cross-sectional area changes between the ink supply paths 22 and the pressure chambers 20 (increases from the ink supply paths 22 to the pressure chambers 20). In this embodiment, the protrusions 37 are each formed as a semi-spherical protrusion and arrayed in matrix on the inclined surface 39.

By providing a plurality of protrusions 37 on the respective inclined surfaces 39, small turbulent flows are generated by protrusions 37 in vicinity to the inclined surface 39 as indicated by Z in FIG. 3 when ink flows from the ink supply paths 22 to the pressure chambers 20. That is, a boundary layer of turbulent flow is formed in vicinity to the inclined surface 39. As a consequence, separation does not easily occur between a flow from the ink supply paths 22 to the pressure chambers 20 (laminar flow) and the boundary layer of turbulent flow, thereby preventing occurrence of a larger turbulent flow. Accordingly, when ink containing tabular particles A is ejected, a local revolving flow of tabular particles A due to a boundary layer separation is not occurred in the pressure chambers 20 at the boundary between the ink supply paths 22 and the pressure chambers 20, thereby allowing ink containing the tabular particles A to smoothly flow toward the nozzles 23. Therefore, it is possible to prevent occurrence of ejection problems due to revolving of tabular particles A in the pressure chambers 20, that is, turning of flying direction of ink ejected from the nozzles 23 and a so-called missing dots which is a failure of ejection of ink from the nozzles 23.

The invention is not limited to the above embodiment, and various modifications can be made thereto within the scope of the attached claims.

First Modified Example

Figure 5:
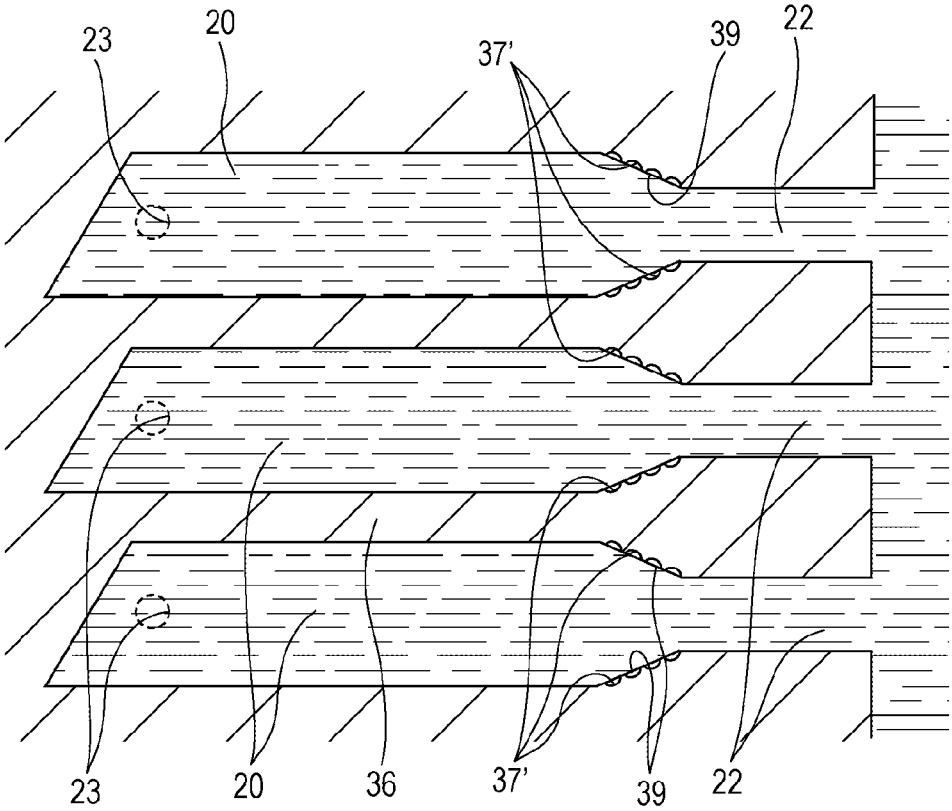
FIG. 5 is a plan view of an essential part showing a pressure chamber forming substrate according to a first modified example.

FIG. 5 is a plan view of an essential part showing the pressure chamber substrate 14 according to a first modified example of the invention. In the above embodiment, the inclined surface 39 which is continuous with a wall of the ink supply paths 22 and a wall of the pressure chambers 20 and is located in an area in which a flow path cross-sectional area changes between the ink supply paths 22 and the pressure chambers 20 is described as being formed at a position on one side of the flow path in the nozzle array direction. However, the invention is not limited to the above embodiment. In the first modified example, two inclined surfaces 39 are formed in each of the pressure chambers 20 such that each inclined surface 39 is provided on each side of the flow path in the nozzle array direction. Although the protrusions 37 are described as the resistance section of the invention in the above embodiment, the resistance section is not limited thereto. In the first modified example, a plurality of dents 37' (dimples) as the resistance section are arrayed in matrix on the inclined surface 39. This configuration has the same effect as that of the above embodiment. That is, a plurality of dents 37' formed on the inclined surface 39 contribute to generate a boundary layer of turbulent flow to be formed in vicinity to the inclined surface 39 when ink flows from the ink supply paths 22 to the pressure chambers 20, thereby preventing occurrence of a larger turbulent flow. Accordingly, it is possible to prevent occurrence of ejection problems due to revolving of tabular particles A in the pressure chambers 20. Thus, the resistance section can be embodied in any shapes and numbers as long as it resists a flow of ink flowing between the ink supply paths 22 and the pressure chambers 20. For example, the resistance section may be formed as a plurality of ribs or a plurality of channels arrayed in a direction perpendicular to the flow of ink on the inclined surface 39. Alternatively, the inclined surface 39 per se may be formed in a stepped shape having a plurality of stepped portion. In this case, the resistance section can be easily formed by anisotropic etching of the pressure chamber substrate 14 made from a silicon single crystal substrate.

In the above embodiment, although the flow path cross-sectional area of the ink supply paths 22 is described as being smaller than the flow path cross-sectional area of the pressure chambers 20 by providing the width (the dimension in the nozzle array direction) of the ink supply paths 22 smaller than the width of the pressure chambers in the same direction, the invention is not limited thereto. A configuration is also possible in which the flow path cross-sectional area of the ink supply paths 22 is smaller than the flow path cross-sectional area of the pressure chambers 20 by providing the height (the dimension in a direction vertical to the pressure chamber substrate 14) of the ink supply paths 22 smaller than the height of the pressure chambers in the same direction. In this case, the resistance section such as the protrusions 37 and the dents 37' are formed on the inclined surface at the boundary between the ink supply paths 22 and the pressure chambers 20 in an area in which the flow path cross-sectional area increases in the height direction.

Second Modified Example

Figure 6:
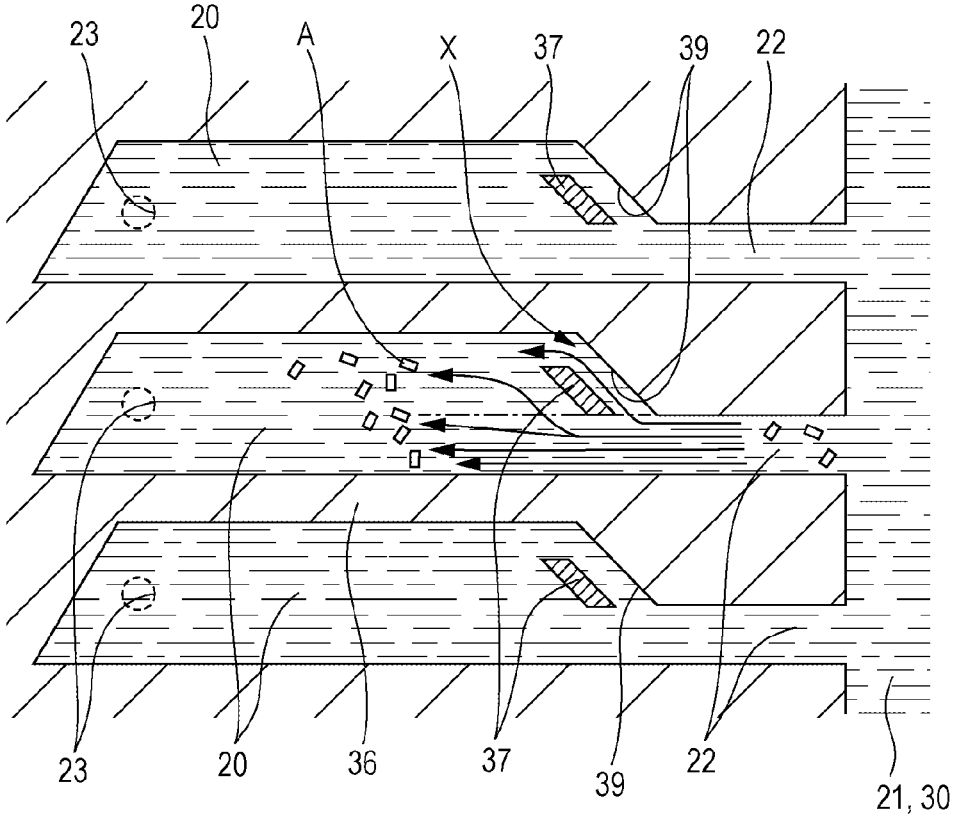
FIG. 6 is a plan view of an essential part showing a pressure chamber forming substrate according to a second modified example.

Although a plurality of protrusions 37 or dents 37' are formed on the inclined surface 39 in the first modified example, a divider as the resistance section may be provided between the ink supply paths 22 and the pressure chambers 20. FIG. 6 is a plan view of an essential part of the pressure chamber substrate 14. In FIG. 6, the arrow indicates the flow of ink. Although FIG. 6 shows a configuration for three nozzles, the ink flow paths which correspond to other nozzles 23 have the same configuration. As described above, the divider 37 (a type of resistance section of the invention) that resists the flow of ink is formed at each of the boundary between the ink supply paths 22 and the pressure chambers 20. More specifically, the divider 37 is formed in an area (which is denoted by X in FIG. 6) in which the flow path cross-sectional area changes between the ink supply paths 22 and the pressure chambers 20 (increases from the ink supply paths 22 to the pressure chambers 20) at a position outside of the virtual extension area of the ink supply paths 22 into the pressure chambers 20. The divider 37 of the second modified example is formed as a quadrangular prism which extends from the bottom of the pressure chambers 20 to the surface of the elastic film 16 with the cross section in a parallelogram shape.

The divider 37 is disposed spaced from the inclined surface 39 that connects the wall (the side face parallel to the partition wall 36 of the pressure chambers 20) of the ink supply paths 22 and the wall (partition wall 36) of the pressure chambers 20. A side face of the divider 37 which opposes the inclined surface 39 is parallel to the inclined surface 39. A space between the inclined surface 39 and the divider 37 serves as a branched path. That is, the flow of ink flowing from the ink supply paths 22 to the pressure chambers 20 is divided by the divider 37 into a main flow which flows into the extension area of the ink supply paths 22 and a branched flow which flows into the branched path. The divided flows of ink merge in the pressure chambers 20. The flow path cross-sectional area of the branched path is desirably smaller than the flow path cross-sectional area of the ink supply paths 22. With this configuration, a flow speed of ink can be prevented from decreasing.

By providing the divider 37 in the area X, local revolving flow of ink in the area X is reduced, thereby preventing stagnation of ink in the area X. Accordingly, when ink containing tabular particles A is ejected, a local revolving flow of tabular particles A due to a turbulent flow (eddying flow) in the pressure chambers 20 at the boundary between the ink supply paths 22 and the pressure chambers 20 can be reduced, thereby allowing ink containing the tabular particles A to smoothly flow toward the nozzles 23. Therefore, it is possible to prevent occurrence of ejection problems due to revolving of tabular particles A in the pressure chambers 20, that is, turning of flying direction of ink ejected from the nozzles 23 and a so-called missing dots which is a failure of ejection of ink from the nozzles 23.

Third Modified Example

Figure 7:
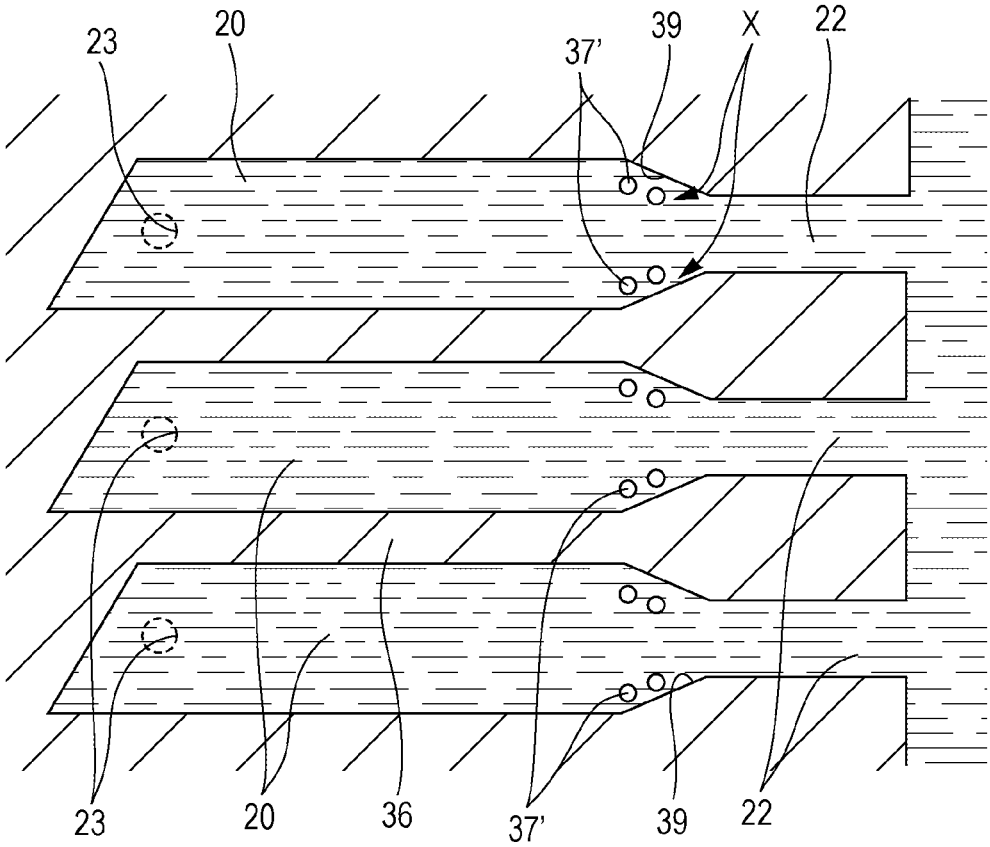
FIG. 7 is a plan view of an essential part showing a pressure chamber forming substrate according to a third modified example.
Figure 8:
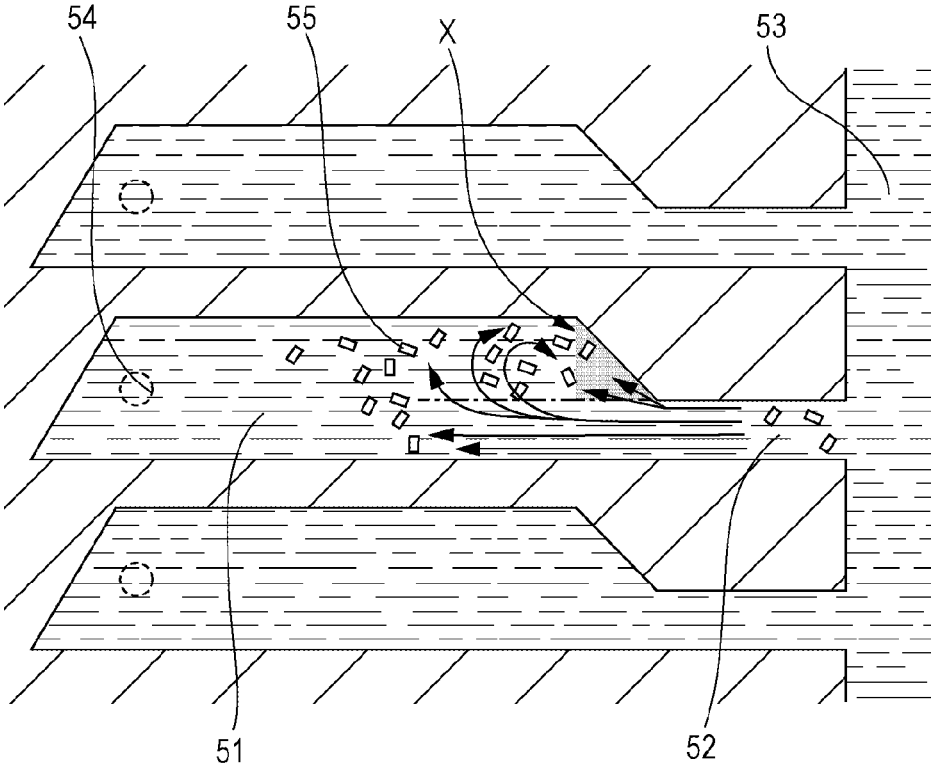
FIG. 8 is a plan view showing a configuration of a conventional pressure chamber forming substrate.

FIG. 7 is a plan view of an essential part showing the pressure chamber substrate 14 according to a third modified example of the invention. In the above embodiment, the area in which a flow path cross-sectional area changes between the ink supply paths 22 and the pressure chambers 20 and is located outside of the virtual extension area of the ink supply paths 22 is described as being formed at a position on one side of the flow path in the nozzle array direction. However, the invention is not limited to the above embodiment. In the third modified example, two areas are formed with each area provided on each side of the flow path in the nozzle array direction. Although the divider 37 is described as the resistance section of the invention in the second modified example, the resistance section is not limited thereto. In the third modified example, a cylindrical members 37' as the resistance section may be disposed in the area X at positions outside of the virtual extension area of the ink supply paths 22 on each side of the flow path in the nozzle array direction. Further, a plurality of (two, in this modified example) cylindrical members 37' are disposed spaced from the inclined surface 39 and along the inclined surface 39. With this configuration, similarly to the above embodiment, a flow speed of ink at the boundary between the ink supply paths 22 and the pressure chambers 20 where the flow path cross-sectional area changes can be prevented from decreasing. Accordingly, an eddying flow of ink at the boundary between the ink supply paths 22 and the pressure chambers 20 can be reduced, thereby preventing the tabular particle A from revolving by the eddying flow. Therefore, it is possible to prevent occurrence of ejection problems due to revolving of tabular particles A in the pressure chambers 20. The resistance section can be embodied in any shapes and numbers as long as it resists a flow of ink and prevents a flow speed of ink from decreasing in the area in which a flow path cross-sectional area changes outside of the virtual extension area of the ink supply paths 22.

In the above embodiment, although the flow path cross-sectional area of the ink supply paths 22 is described as being smaller than the flow path cross-sectional area of the pressure chambers 20 by providing the width (the dimension in the nozzle array direction) of the ink supply paths 22 smaller than the width of the pressure chambers in the same direction, the invention is not limited thereto. A configuration is also possible in which the flow path cross-sectional area of the ink supply paths 22 is smaller than the flow path cross-sectional area of the pressure chambers 20 by providing the height (the dimension in a direction vertical to the pressure chamber substrate 14) of the ink supply paths 22 smaller than the height of the pressure chambers in the same direction. In this case, the resistance section such as the divider 37 and the cylindrical members 37' are formed at the boundary between the ink supply paths 22 and the pressure chambers 20 at positions outside of the virtual extension area of the ink supply paths 22.

In the above embodiment and modified examples, although the recording head 2 is described as the liquid ejection head of this invention, the invention is not limited thereto. The invention may be applied to a liquid ejection head that ejects liquid containing tabular particles, for example, a color material ejection head for display manufacturing apparatuses that ejects solution of color materials, red (R), green (G) and blue (B), an electrode material ejection head for electrode manufacturing apparatuses that ejects electrode material in the form of liquid, and a bio-organic material ejection head for chip manufacturing apparatuses that ejects a bio-organic solution.

The entire disclosure of Japanese Patent Application No. 2012-168077 filed Jul. 30, 2012 is expressly incorporated by reference herein.

What is claimed is:

1. A liquid ejection head that is configured to eject liquid containing tabular particles comprising:

a plurality of nozzles that eject the liquid;

a plurality of pressure chambers that communicate with the plurality of nozzles;

a pressure generating unit that generates pressure change in the plurality of pressure chambers;

a common liquid chamber that communicates with the plurality of pressure chambers;

a liquid supply path that connects the plurality of pressure chambers and the common liquid chamber; and a resistance section that resists a flow of the liquid being provided at a wall located inside of each of the plurality of pressure chambers adjacent to the liquid supply path, wherein the resistance section is configured with a plurality of protrusions.

2. The liquid ejection head according to claim 1, wherein the plurality of protrusions project lateral to the flow of the liquid.

3. A liquid ejection apparatus comprising the liquid ejection head according to claim 2.

4. A liquid ejection apparatus comprising the liquid ejection head according to claim 1.

5. The liquid ejection apparatus according to claim 4, wherein a height of the each of the plurality of pressure chambers is higher than a height of the liquid supply path, and the wall at which the resistance section is provided is continuously formed with a wall of the liquid supply path, and the wall at which the resistance section is provided is angled with respect to the wall of the liquid supply path.

6. The liquid ejection head according to claim 1, wherein a height of the each of the plurality of pressure chambers is higher than a height of the liquid supply path, and the wall at which the resistance section is provided is continuously formed with a wall of the liquid supply path, and the wall at which the resistance section is provided is angled with respect to the wall of the liquid supply path.

* * * * *